US009353450B2

(12) United States Patent
Morelle et al.

(10) Patent No.: US 9,353,450 B2
(45) Date of Patent: May 31, 2016

(54) ELECTROLYZER APPARATUS

(75) Inventors: Philippe Morelle, Alsemberg (BE); Joachim Lange, Tervuren (BE); Christoph Sommer, Neckarsulm (DE)

(73) Assignee: SOLVAY SA, Brussels (BE)

( * ) Notice: Subject to any disclaimer, the term of this patent is extended or adjusted under 35 U.S.C. 154(b) by 137 days.

(21) Appl. No.: 13/988,027

(22) PCT Filed: Nov. 16, 2011

(86) PCT No.: PCT/EP2011/070286

§ 371 (c)(1), (2), (4) Date: May 17, 2013

(87) PCT Pub. No.: WO2012/066054

PCT Pub. Date: May 24, 2012

(65) Prior Publication Data

US 2013/0233723 A1 Sep. 12, 2013

(30) Foreign Application Priority Data

Nov. 17, 2010 (EP) ..... 10191586

(51) Int. Cl.
*C25B 15/02* (2006.01)
*C25B 1/24* (2006.01)

(52) U.S. Cl.
CPC ..... *C25B 15/02* (2013.01); *C25B 1/245* (2013.01)

(58) Field of Classification Search
CPC ..... C25B 1/245; C25B 15/02
See application file for complete search history.

(56) References Cited

U.S. PATENT DOCUMENTS

| | | | | |
|---|---|---|---|---|
| 4,749,453 | A * | 6/1988 | Harris | 205/343 |
| 6,210,549 | B1 | 4/2001 | Tharp | |
| 2003/0098038 | A1 * | 5/2003 | Siegele et al. | 134/1.1 |
| 2004/0037768 | A1 * | 2/2004 | Jackson | 423/500 |
| 2004/0238374 | A1 | 12/2004 | Tojo et al. | |

FOREIGN PATENT DOCUMENTS

| | | | |
|---|---|---|---|
| EP | 2006417 | A2 | 12/2008 |
| WO | WO 2010026079 | A1 | 3/2010 |

* cited by examiner

*Primary Examiner* — Nicholas A Smith

(57) ABSTRACT

An electrolyzer apparatus for the electrolytic manufacture of elemental $F_2$ from an electrolyte/HF-solution, e.g., KF×1.8 HF, comprising at least one electrolytic cell which contains at least two anodes, often 20 to 30 anodes, a metallic cathodic vessel, and at least two rectifiers such that each anode is allocated to one rectifier. In this manner, each anode can be controlled and regulated individually. Failure of each individual anode, e.g., anode break, causes the production of undesired side products, e.g., of $CF_4$. Any faulty anode can be detected easily, and each anode can be shut off individually, if needed, and repaired.

18 Claims, 4 Drawing Sheets

ELECTROLYZER APPARATUS

The present application is a U.S. national stage entry under 35 U.S.C. 371 of International Application No. PCT/EP2011/070286 filed Nov. 16, 2011, which claims priority to European patent application No 10191586.6 filed on Nov. 17, 2010, the whole content of this application being incorporated herein for all purposes.

The invention concerns an electrolyzer apparatus and a method of producing elemental fluorine.

Elemental fluorine is applied for a lot of purposes. It can be used for the surface fluorination of polymers, for example to manufacture car tanks with lower permeability for fuel. Highly pure elemental fluorine is applied as etching agent or chamber cleaning agent in the manufacture of semiconductors, photovoltaic cells, micro-electromechanical devices and flat panel displays.

Fluorine is widely produced electrolytically from HF. In the presence of an electrolyte salt, HF releases fluorine if a voltage of at least 2.9 V is applied. Practically, the voltage is often kept in a range of 8 to 10 or 11 Volt.

A molten HF adduct of KF, often having the formula KF·(1.8–2.3)HF, is the preferred electrolyte salt. HF is fed into the reactor containing the molten electrolyte salt, and $F_2$ is electrolytically formed from the HF according to the equation (1) by applying a voltage and passing electric current through the molten salt:

$$2HF \rightarrow H_2 + F_2 \quad (1)$$

The electrolysis as known in the state of the art is performed in electrolytic cells; several cells are assembled in a cell room. The cathode of each cell is presented by the cell vessel (also denoted as trough) which is made from metal or metal alloys resistant to HF and $F_2$, especially from stainless steel or nickel. The cell vessel is connected to the (−) pole of a rectifier or it is further linked onto the next anode bus bar in case of serial connection. Each cell often contains several anodes, typically 20 to 30, which may be, for example, nickel anodes, carbon, sintered material, diamond-coated anodes or comparable materials, but usually are made from carbon. A single rectifier's (+) pole side (or a cathode in case of serial connection) is connected to a (+) bus bar mounted onto the electrolytic cell supplying different anodes in parallel. The electrolysis cells of a respective cell room are preferably connected in series by a direct current (DC) conductor system which loops from the rectifier (+) pole to the anode bus thus connecting the different anodes in parallel.

The DC current is imposed by a closed current loop control through a single rectifier (commercially available) which supplies all the DC current into the DC bus bar system. The electrolytic cells are connected in series from (+) to (−), connecting the (+) pole of a main bus bar to the anode of the first cell and the (−) pole of a main bus bar to the cathode of the last cell; in between, the respective cathode is connected with the respective anode by a short bus bar. In such a serial connection individual cells may be bypassed by a short circuit switch.

The distribution of electric current among parallel anodes of the described cells shows various influencing parameters in respect to the ohmic resistance between cathodes and anodes. The bus bars between the connecting points may have a different size (length and/or width), there may be differing contact resistances, the anode resistance may differ, the anodes may have differing temperatures, the resistance between anode surface and the electrolyte may differ, the electrolyte resistance may differ due to varying compositions of the electrolyte, due to geometry, e.g. of the anodes, the cell or the arrangement of the anodes, differing temperatures of it and possible fluctuations of the electrolyte in the cell, the HF supply and/or the filling level of the cell may be different and vary, there may be influences by electric field effects, the contact surface and the resistance of the cathode vessel may differ etcetera. As a consequence, each anode-cathode loop may have (and often has) an individual ohmic resistance. The differences of the ohmic resistance of individual anodes cannot be influenced or controlled by variation of the voltage, and the highest current will pass through the anode with the lowest resistance between the connection point on the anode side and the cathode side. It was observed that the current passing through the anodes may differ strongly, in a ratio of 1.5:1. Consequently, anodes conducting higher current may overheat, surface wear of the anodes may vary, the anode may erode and break, and undesired reaction products may be observed as a consequence, e.g. $CF_4$, $C_2F_6$ or other perfluoro compounds, especially if a worn carbon anode breaks or burns in the $F_2$ atmosphere. Pieces of broken anodes may provoke a short circuit inside the cell, with the risk of heavy reactions inside the cell. It was mentioned above that electrolytic cells often have 20 to 30 anodes, and it is difficult and time consuming to search for the faulty anode after signs of malfunction is observed. The necessary shutdown of the electrolytic cell is undesired of course, in view of economic efficiency. Especially annoying is the increase of the $CF_4$ content, because in certain applications, e.g. in the manufacture of photovoltaic cells, TFTs or semiconductors, highly pure $F_2$ is required.

Problem to be solved by the invention is to provide an improved electrolyzer apparatus for the manufacture of $F_2$, especially, for the manufacture of highly pure $F_2$ as needed for the application in the electronic industry, for example, in the manufacture of semiconductors, photovoltaic cells, micro-electromechanical systems and TFTs.

The electrolyzer apparatus for the electrolytic manufacture of elemental $F_2$ from an electrolyte comprises at least one electrolytic cell which contains at least two anodes, a vessel for the electrolyte where the vessel also serves as cathode, and at least two rectifiers such that one rectifier is allocated to one anode. The term "one rectifier is allocated to one anode" means that each rectifier is allocated to only one anode, and that each anode is allocated to only one rectifier. Preferably, the electrolytic cell contains more than 2 anodes and more than 2 rectifiers. Thus, if the cell contains 26 anodes, the apparatus comprises 26 rectifiers, one rectifier for each of the anodes. As will be described in detail below, two rectifiers can be combined to form a dual rectifier; still, also in this embodiment, always one individual rectifier in this dual rectifier is allocated to a specific anode. The provision of dual rectifiers is especially advantageous for plants producing $F_2$ for semiconductor applications, especially for the use as etchant and chamber cleaning agent in the manufacture TFTs and especially of photovoltaic cells. The term "rectifier" denotes a single rectifier; two combined rectifiers are denoted as "dual rectifiers". If in the following description, a certain number "x" of rectifiers are mentioned, then the reader will know that alternatively, "x/2" dual rectifiers can be provided.

DETAILED DESCRIPTION OF THE INVENTION

Figure 1:
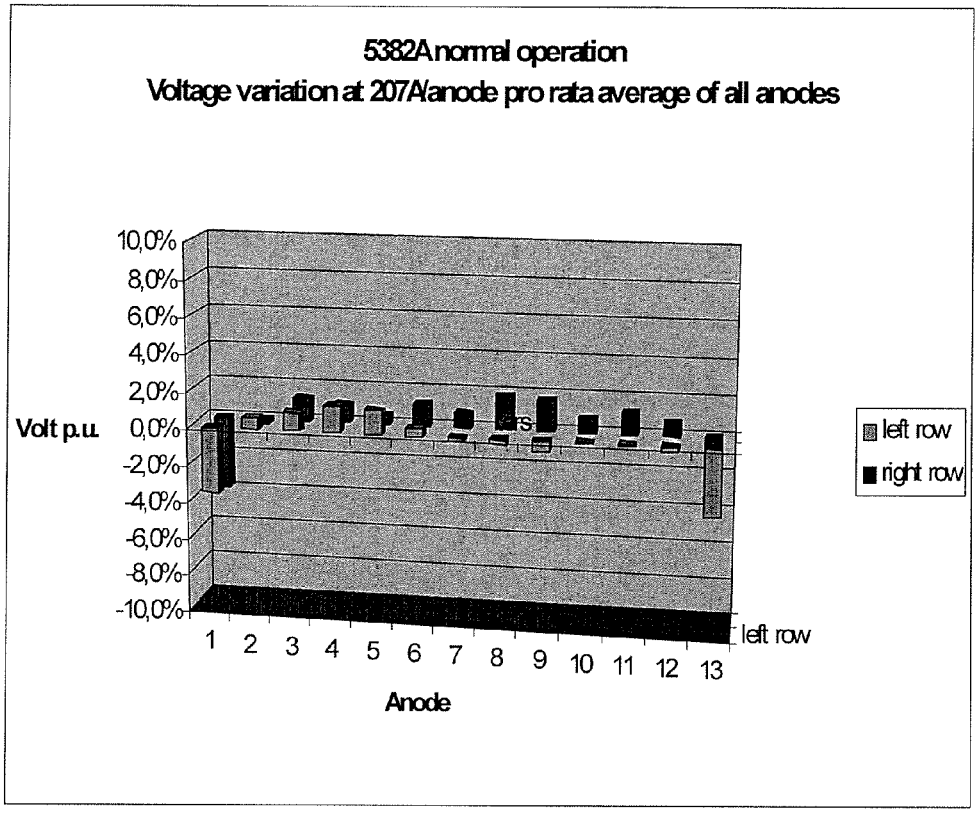
FIG. 1 indicates the voltage variation for a cell having 26 anodes in normal operation.

FIG. 1 demonstrates the voltage variation in normal operation (no broken anodes) for a cell with a total current of 5382 amperes and an average of 207 amperes per anode. It shows a tolerance band and variations of voltage for 26 anodes, the rectifiers grouped in 26 rectifiers in an electrolyzer apparatus of the present invention. Dual rectifiers comprising two rectifiers inside one housing may be applied; this was tested successfully in pilot installations. The data given in FIG. 1 wee obtained using an apparatus with dual rectifiers; the term "left row" and "right row" denotes the arrangement of the anodes in the form of two rows in the cell. As indicated in FIG. 1, the total range of variation among the anodes is less than 6% which is to be compared with the state of the art systems where a variation of approximately ±25% can be observed. Anodes' rectifiers are imposing exactly the same current per anode, so the variation among anodes is expressed by voltage tolerance for each operating anode (arranged in two rows).

DETAILED DESCRIPTION OF THE INVENTION

In the following, FIG. 2 will be described in detail.

Figure 2:
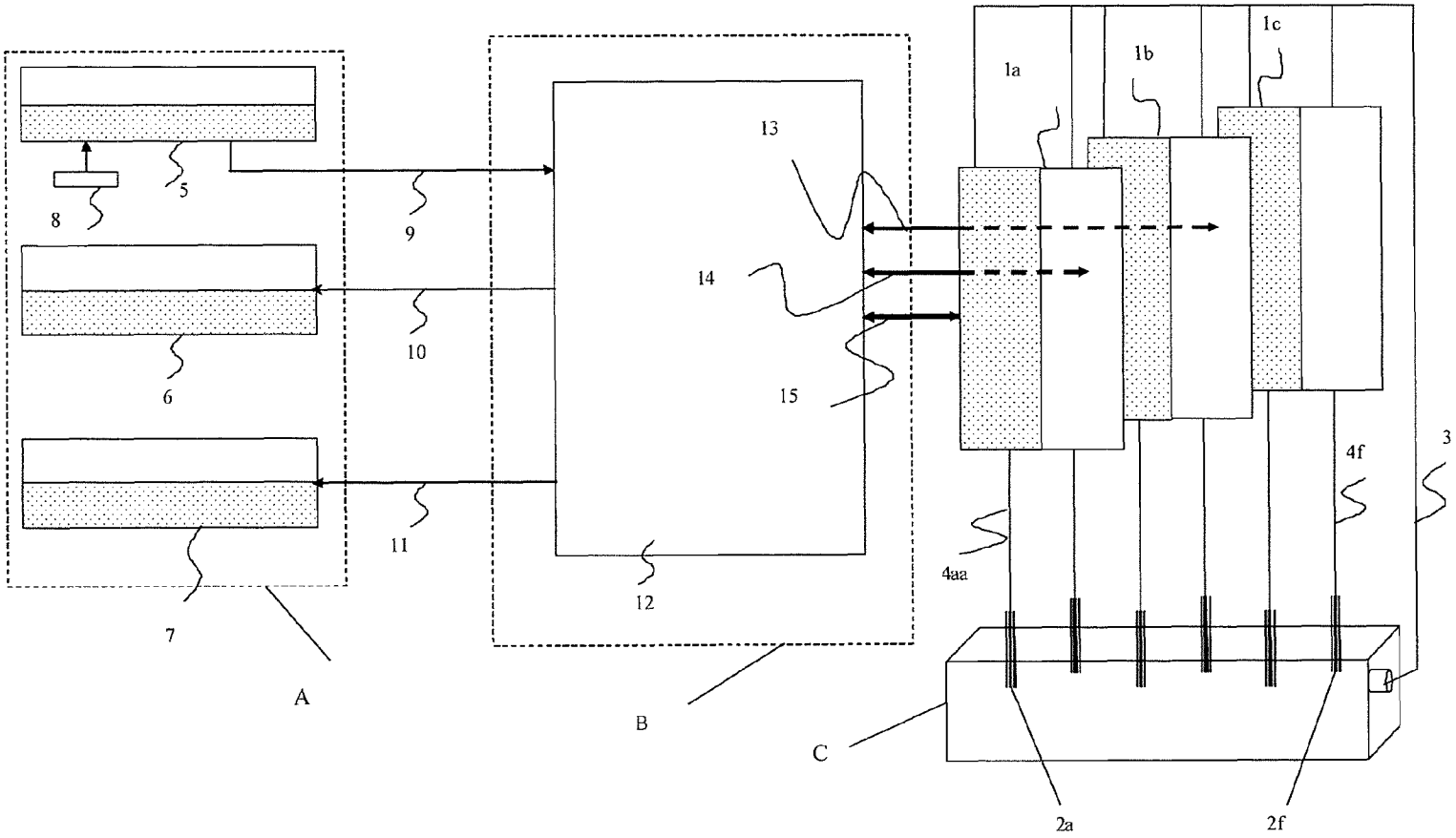
FIG. 2 provides a scheme of an electrolyzer apparatus of the present invention including a Basic Process Control System BPCS.

FIG. 2 provides a scheme of an electrolyzer apparatus of the present invention including a Basic Process Control System BPCS (consisting of a Distributed Control System DCS referenced as A and a Programmable Logic Controller PLC referenced as B), an electrolytic cell C, a multitude of rectifiers 1 and a respective multitude of anodes 2.

The apparatus comprises a Basic Process Control System BPCS consisting of a distributed control system DCS referenced as A, a programmable logic controller PLC referenced as B and an electrolytic cell C. The programmable logic controller PLC may be realized as discrete unit or could be a part of a distributed control system DCS.

The distributed control system DCS A serves mainly three purposes: it receives/generates the master current set point, it allows individual adjustments per anode generating an individual set point for each anode rectifier individually, and it sets technical limits as there are rectifier limit voltage and rectifier limit current. It also indicates, preferably in respective instruments which give the value in digits or in analogous form, actual values for current, voltage as determined by sensors.

The PLC B contains programmable logics which compare the individual settings of the anodes with the values provided by measurements and prompts an increase or decrease of the voltage or increase of current of individual anodes in case of a deviation from the settings. It also includes an "on/off" logic which provides a smooth start of the electrolysis process after shut down, and a shut down control after operation. Programmable logic controller B preferably also comprises programmable logic which may interact with plants emergency shutdown system.

The apparatus of FIG. 2 also contains an electrolytic cell C.

The apparatus may comprise a multitude of rectifiers 1*a*, 1*b* . . . , preferably 20 to 30, or, alternatively, 10 to 15 dual rectifiers, and a multitude of anodes 2*a*, 2*b*, . . . , for example, 20 to 30. Always one rectifier is connected with one anode. In the apparatus of FIG. 2, two rectifiers are always grouped into one dual rectifier, indicated in FIG. 2 as dual rectifier 1*a*, 1*b* and 1*c*; but also when such dual rectifiers are applied in the process of the present invention, each rectifier of this dual set is connected to one individual anode. In the apparatus of FIG. 2, only six anodes 2*a* . . . 2*f* and only three dual rectifiers 1*a*, 1*b* and 1*c* are displayed for the sake of simplicity; it should be kept in mind, however, that often, the number of rectifiers and anodes will be higher, e.g. from 26 to 30 rectifiers or 13 to 15 dual rectifiers per cell. If, for example, 26 anodes 2*a* . . . 2*z* are contained in the cell, 13 dual rectifiers 1*a*, 1*b*, 1*c*, . . . 1*k* would be present.

All rectifier (−) poles are connected to the vessel C (which is the cathode) by a single bus bar 3. Each rectifier 1*a*, 1*b* . . . is connected individually via a conductor 4*a*, 4*b*, . . . 4*f* to an anode 2*a*, 2*b* . . . 2*f*.

The Distributed Control System DCS A comprises a unit 5 wherein individual anode current correction factors can be set for the anodes 21, 2*b*, however the purpose is to distribute the current master set point entered in unit 8 to the individual rectifiers. Unit 5 also contains a display for the settings and an indication of individual rectifier set points.

The Distributed Control System DCS A also comprises a unit 6 where the measured individual current is displayed which passes through each anode 1*a*, 1*b*, . . . , and a unit 7 displaying the measured voltage at the individual anodes 2*a*, 2*b* . . . . Both displays 6 and 7 indicate alarms when limits the operation limit curve of current and voltage would be exceeded.

The set points and correction factors are fed to the programmable logic controller PLC 12 via data line 9, and transmitted through the lines 13, 14, 15 and other lines (not incorporated in FIG. 2) to other rectifiers (not incorporated in FIG. 2 for the sake of clarity) from PLC to the rectifier control. The rectifier control itself provides data relating to current and voltage measurements of the anodes through the lines 13, 14, 15 back to the PLC controller and PLC feds back via lines 10 and 11 to the units 6 and 7 to be displayed.

Advantages of the invention, for example, avoiding short circuits and avoiding total shut down of the electrolytic cell in case one anode causes problems, relate to any type of electrode, e.g. nickel anodes, diamond coated anodes and carbon anodes. Preferably, the anodes are carbon anodes.

Preferably, the electrolyzer apparatus of the invention contains equal to or more than 3 electrolytic cells, preferably, equal to or more than 5 electrolytic cells.

Preferably, the electrolyzer of the present invention contains equal to or less than 15 electrolytic cells, preferably equal to or less than 10 cells.

Each electrolytic cell preferably contains equal to or more than 6 anodes, more preferably, equal to or more than 10 anodes. Preferably, each electrolytic cell contains equal to or less than 50 anodes. Preferably, each electrolytic cell contains 20 to 30 anodes.

The apparatus further may comprise a programmable logic controller (PLC) and/or a distributed control system (DCS). For a smaller and simple apparatus, a PLC may not be necessary; or, alternatively, no DCS is necessary, but just a PLC is provided in the apparatus. Often, especially in larger apparatuses, it is preferred to provide both a PLC and a DCS.

In a preferred embodiment, the electrolyzer apparatus of the invention contains at least one distributed control system DCS. The distributed control system DCS may be a mimic board or mosaic board or may be represented by a computer system. The preferred distributed control system is realized with computers. The programmable logic controller PLC serves to handle, monitor and survey data concerning the set points assuring that this values cannot exceed technological limits in normal operation (minimum/maximum level of voltage in dependence of current of each individual anode), input for technical limits of set values, input for correction factors for individual anodes, input of overall set points, especially the minimum or maximum level of total current passing through all anodes and cells, reception of measurements values related to foresaid signals and alarm handling.

The apparatus further comprises a programmable logic controller PLC. The programmable logic controller PLC receives information from rectifiers delivering measured parameters (individual current and voltage) of the respective anodes. The programmable logic controller PLC compares the measured parameters with the settings and set points provided by distributed control system DCS. Depending on the result of the comparison, the PLC does not prompt any change or it detects an overrun of preset limits. If the comparison of settings and measurements gives a deviation which is outside the correction band—for example, if the deviation of setting value and determined value of current and/or voltage is not in a predetermined tolerance band, but, e.g. greater than 5%—, the PLC will prompt the shutdown of the respective anode for maintenance or repair. It may also send an acoustic or visual signal, e.g. to the control board.

A broken anode is often indicated by a significant increase of voltage operating the anode at preset current. In complement a short circuit of an anode can be detected in the electrolytic cell when the current exceeds its limits and the voltage drops below limits. Such short circuits are generated often by fragments of anodes swimming inside the electrolyte, as these could be conductive carbon pieces.

The term "tolerance band" denotes a specific acceptable minimum value of each parameter, and a specific acceptable maximum value of each parameter. If the parameter or parameters are within this tolerance band, no action of the PLC is necessary. For example, the tolerance band for the DC voltage may be set to 4 to 12 V. The tolerance band for the current may be set to 5 to 250 Ampere. Preferably, the tolerance bands for DC voltage and current are linked. For example, for a voltage of 10 V, the tolerance band for the current of 100 to 240 A may be allocated. Or, for a current of 200 A, the tolerance band for the voltage of 9 to 11.5 V may be allocated.

In the following table 1, preferred tolerance bands for a current (given in Ampere) for a given voltage (in Volt) are compiled:

TABLE 1

Preferred tolerance band for current for a given DC voltage

| | Tolerance band for current | |
|---|---|---|
| Voltage [V] | Minimum [A] | Maximum [A] |
| 4 | >0 | 8 |
| 6 | 2 | 40 |
| 7 | 10 | 80 |
| 8 | 40 | 120 |
| 9 | 65 | 190 |
| 10 | 100 | 240 |
| 11 | 160 | 240 |

In table 2, preferred tolerance bands for the voltage for a given current are compiled:

TABLE 2

Preferred tolerance band for DC voltage (in Volt) for a given current (in Ampere):

| | Tolerance band for voltage | |
|---|---|---|
| Current [A] | Minimum [V] | Maximum [V] |
| 20 | 5 | 7.5 |
| 40 | 6 | 8 |
| 60 | 6.5 | 9 |
| 80 | 7 | 9.5 |
| 100 | 7.5 | 10 |
| 120 | 8 | 10.5 |
| 140 | 8.2 | 10.8 |
| 160 | 8.5 | 11 |
| 180 | 9 | 11.2 |
| 200 | 9.2 | 11.4 |
| 220 | 9.5 | 11.5 |
| 240 | 9.8 | 11.8 |

It is preferred that the voltage remains in the indicated preferred tolerance bands. It is especially preferred that the current remains in the indicated preferred tolerance bands. If the current is outside the tolerance band for a given voltage, the voltage of the respective will be increased or decreased so that the current is then within the tolerance band. In the preferred case the current will be controlled by a closed loop PID regulator for each anode (PID=Proportional, Integral, Differential), comparing the current set-point and the measured current and sending, in case of deviation, a re-adjusted current set-point to the rectifier. The PID regulator can be realized inside the (commercialized) rectifier or outside or inside in the PLC. In the preferred case the closed loop PID is realized inside the rectifier controller which regulates the closed current loop.

It has to be noted that the tolerance bands for voltage and current may vary slightly from anode to anode, e.g. from the geometric form of the anode, the composition of the anode, and the surface of the anode or the geometrical form of the cathode around the anode. The advantage of the electrolyzer apparatus of the present invention is that the properties of each individual anode can be taken into account when setting the tolerance bands and that specified operation conditions can be closely monitored and controlled inside their tolerances obtaining a well specified electrolytic product.

In a preferred embodiment, the PLC is programmed in such a way that if the measured parameter of a specific anode deviates by more than a preset level from the upper or lower limit of the tolerance band, the respective anode will be shut down. It is especially preferred that the anode will be shut down if the measured parameter deviates by more than a preset level from the upper limit of the tolerance band because this indicates a failure of the respective anode. For example, the shutdown level of the deviation may be set to equal to or more than 10% from the upper limitation of the tolerance band; this shutdown level is called the "divergence factor" in the present application. Preferably, the shutdown level is set to a deviation of equal to or more than 5% of the upper limit of the tolerance band. Thus, if the voltage or current must be decreased by 5% or more of the upper limiting value of the tolerance band, then the current passing through the respective anode will be stopped, and the anode, the bars, connections etc may be inspected for repair or substitution. Often, a broken anode will be the cause if the current and voltage are outside the upper limit of the tolerance band. As mentioned above, such irregularities may result in an unacceptable production of side products like $CF_4$. The electrolyzer apparatus of the invention allows for the selective shutdown of single irregularly operating anodes without the necessity of complete interruption of $F_2$ production.

The PLC often will also contain an on/off logic. This on/off logic controls the individual anodes and rectifiers to safeguard a smooth start up phase and a smooth shutdown phase.

If desired, the PLC may also comprise again logics for other features, for example a manual shutdown of a single anode when operator observes other technical issues like contact surface overheating.

If desired, the PLC may also comprise again functionalities for other features, for example comparing well proven operation conditions (in example proven research results of operation conditions versus product quality) with present measured operation conditions, again there could be parameter adapted tolerance bands (like electrolyte temperature adapting the tolerance band) to improve the electrolyzer. Such logic can be realized preferably by calculated reaction functions and comparators or a fuzzy logic.

The PLC preferably also comprises safety ramps, e.g. 1 A/minit to prevent the cell against spontaneous gazing effects.

Each rectifier preferably comprises at least one device measuring parameters of each anode wherein the at least one device is selected from the group consisting of a DC measurement device, a current closed loop control device, a voltage measurement device, a DC current short circuit protection, and a DC voltage overvoltage protection. The parameters obtained by the respective measuring device or devices are sent, preferably on-line, to the PLC needed to determine if a correction must be prompted for any of the anodes or even a shutdown as indicated above. In a preferred embodiment, the DC measurements are realized inside the rectifiers; such rectifiers are commercially available.

The electrolyzer apparatus of the present invention may further comprise devices to measure safety-related parameters. For example, the apparatus may comprise one or more pressure detectors; one or more detectors for the ambient temperature in the apparatus, the electrolyzer liquid, the anodes or lines for the electric current; one or more fire detectors or smoke detectors, e.g. one or more "very early smoke detection apparatus" (VESDA). These safety related parameters are preferably sent to the central control system or PLC which may trigger an acoustic alarm, a visual alarm, the shutdown of single or all anodes, single or all cells or even the complete electrolyzer apparatus, fire fighting or fire preventing actions, e.g. flooding the apparatus with inerting gases, e.g. nitrogen, carbon dioxide, or hydrofluorocarbons, e.g. $C_2HF_5$ or $C_3HF_7$, or mixtures thereof.

The apparatus as described above provides a safe, steady and reliable way of producing pure fluorine. If desired, the apparatus may comprise two redundant central control systems. This guarantees safety and reliability even if one control system should fail.

If desired, and to simplify the control system, two rectifiers can be assembled in a dual rectifier housing; in this embodiment, two anodes can be addressed with one dual rectifier controller containing a single communication port and in present example several dual rectifiers can be connected inside one bus segment to the PLC's bus controller. If desired, the electrolyzer apparatus of the present invention may comprise a bus, e.g. available under the name Profibus DP®, which connects the rectifiers to the programmable logic controller PLC. or to the distributed control system DCS when comprising such PLC functions.

Some advantages of the electrolyzer apparatus of the present invention (e.g. reliability, steady $F_2$ production, decreased risk of contamination with undesired side products) are given above. Another advantage is that no anode bus bar, no central bus bar system, short circuit switches, another rectifier for conditioning the cells during starting phase of the electrolytic process or a central rectifier system is necessary. Compared to the classical design with one common rectifier for several cells in combination with a conditioning rectifier, in present case each rectifier controls its own the cell conditioning procedure and the normal operation mode.

The apparatus operates different from the apparatuses known from the art. In the known apparatuses, overall settings were applied for the totality of anodes; the total current was observed, and it was regulated by the voltage applied to all the anodes. According to the apparatus of the invention, preferably, the level of the current of each individual anode is set and maintained in a set level range or to a set level by varying the voltage. One further advantage is that each of the multitude of rectifiers operates anodes at a well defined current level without significant tolerances, whereas in classical design, there are always anodes, due to variation of above mentioned resistances, which take much more current then others. In the end the highest loaded anodes determine the overall cell stream factor and the anode lifetime.

Thus current density at the anode surface can be better adjusted by present optimized current control compared to classical installations.

Thus, the overall cell stream factor due better equilibrated to anode current limits is expected to be higher.

The electrolyzer apparatus of the present invention can be applied in any manufacturing unit for producing elemental fluorine. It is, as mentioned above, especially suitable for the manufacture of pure fluorine applied as etching gas or chamber cleaning gas in production plants for the manufacture of semiconductors, MEMS, TFTs for flat panel displays and photovoltaic cells. Often, it is desired to produce fluorine "on site" or "over the fence" of such production plants. "On site" means that the fluorine producing apparatus is integrated in the production plant. $F_2$ is provided via respective lines to the point of use. "Over the fence" means that the fluorine producing apparatus is close to the plant, but separated from it, e.g. by fences. This enhances safety because unauthorized persons can be kept off the premises easily. Further, transports of $F_2$ e.g. via road are not necessary as the $F_2$ is produced directly besides the consumer-plant, e.g. photovoltaic-plant.

Figure 3:
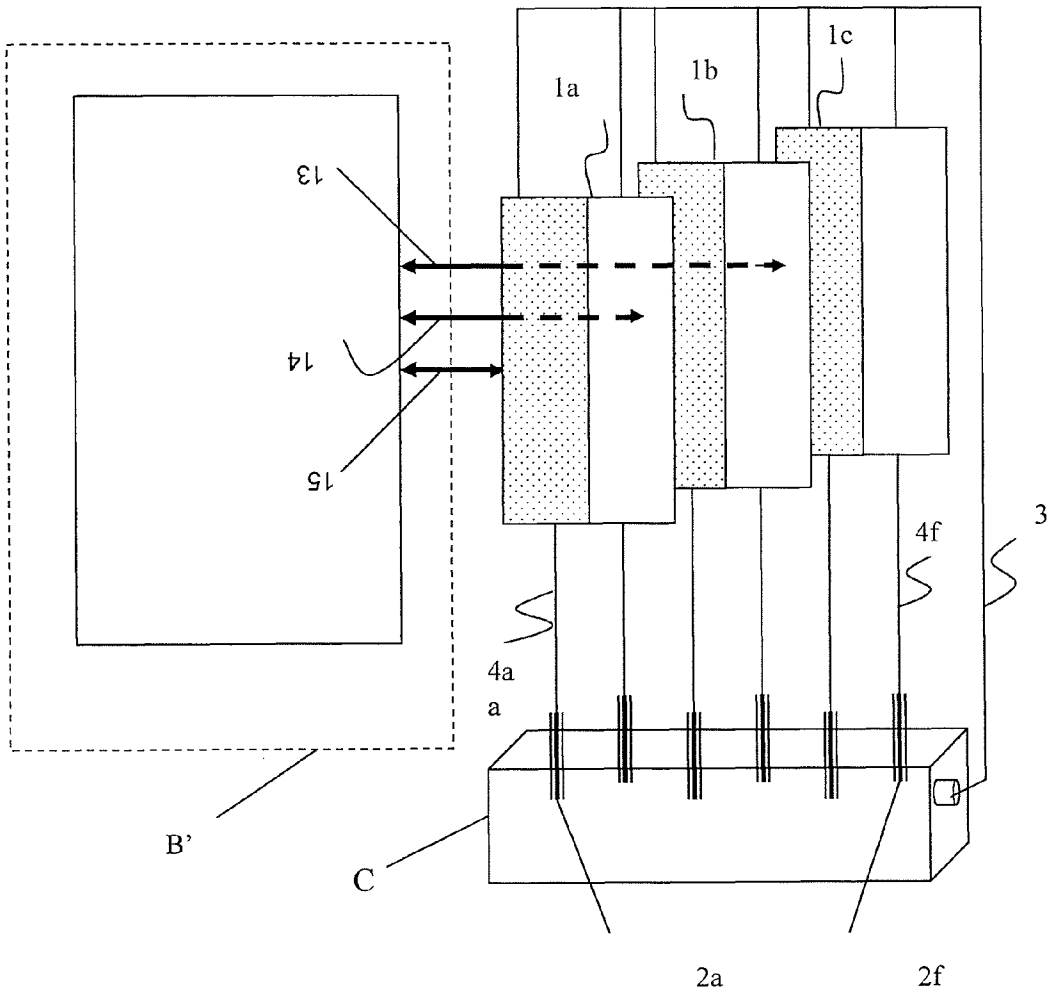
FIG. 3 provides a scheme of an electrolyzer apparatus of the present invention.

FIG. 3 provides a scheme of an electrolyzer apparatus of the present invention, comprising an electrolytic cell C, a multitude of rectifiers 1*a*, 1*b*, . . . to 1*f*. A respective multitude of anodes 2*a*, 2*b* to 2*f* are individually connected via lines 4*a*, 4*b* . . . to 4*f* to one rectifier two of which are grouped as dual rectifiers. The distributed control system and a programmable logic controller are combined in one housing B', which is a BPCS. Line 3 provides the connection to the cell vessel which forms the cathode. The set points and correction factors are transmitted through the lines 13, 14, 15 and other lines (not incorporated in FIG. 2) to rectifiers as also indicated in FIG. 2.

Figure 4:
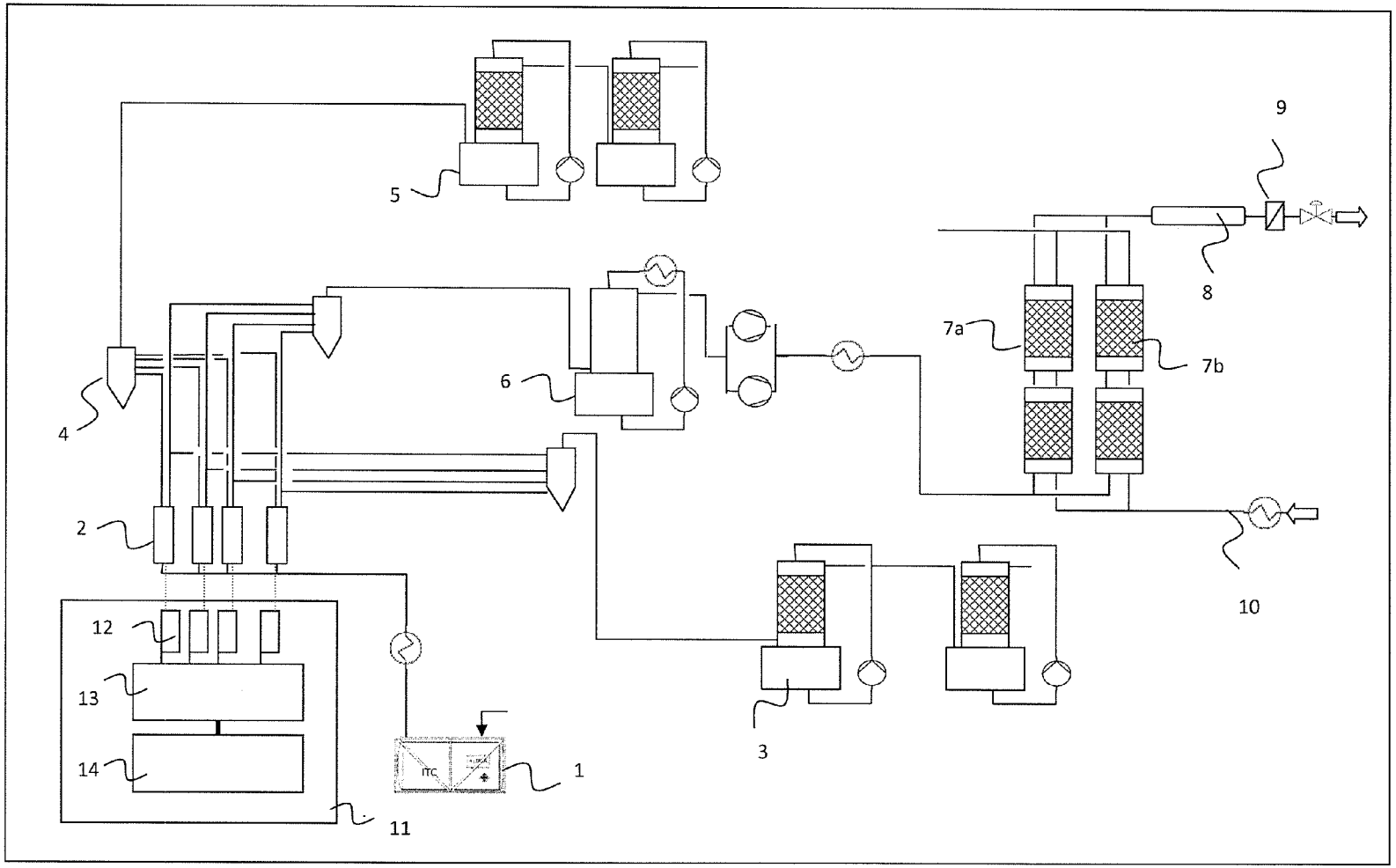
FIG. 4 describes a plant for the manufacture of pure fluorine.

A scheme for a plant for producing pure fluorine using the electrolyzer apparatus of the present invention is given in FIG. 4.

The plant described in FIG. 4 is especially suitable for the manufacture of pure fluorine for the application in the manufacture of TFTs, MEMS, semiconductors, photovoltaic cells, and the cleaning of chambers used especially in these processes.

Liquid HF is stored in buffer tank 1. The liquid HF in the tank is pressurized with $N_2$ and transports the liquid HF to the HF-evaporator which is located between buffer tank 1 and cells 2, but was not given an individual reference in FIG. 4. In the HF-evaporator, the liquid HF is evaporated and being sent in gaseous phase to the electrolytic cells 2. 4 cells are shown in FIG. 4 but it must be kept in mind that the plant may comprise more cells.

In emergency cases, produced $F_2$ can be passed via a hydraulic-seal-system (filled with PFPE-oil=perfluoropolyether as sealing-liquid) or via the settling boxes on the electrolytic cells (for the settling of electrolyte in the gas-stream) to a decomposition unit 3 comprising a destruction tower, preferably a wet scrubbing system where it is decomposed chemically, e.g. with alkali lye which additionally may comprise alkali metal thiosulfate, (for the off gas lines containing $F_2$ and HF from the $F_2$-side of the electrolytic cells), and another scrubber in series for the off-gas from the $F_2$ lines as redundant scrubber and for the case of emergency.

$H_2$ produced is advantageously passed through a settling-box 4 on the electrolytic cells (for settling of electrolyte in the gas-stream) and cleaned in abatement unit 5 (preferably a caustic water scrubbing system for HF in the $H_2$ gas stream). The purified $H_2$ may then be released to the atmosphere. The $F_2$ produced is passed through a separator into a purification unit 6 where it is first contacted with cold liquid HF in a HF scrubber to remove entrained solids, mainly entrained solidified electrolyte salt. After leaving the HF scrubber, the $F_2$ is passed through a heat exchanger which is cooled to about −80° C. to remove entrained HF by condensation. Any residual HF is removed in two NaF towers 7. Highly pure $F_2$ leaving the NaF towers 7 is collected in a buffer tank 8 from which it may be withdrawn though a filter 9 for solids.

The NaF towers 7*a* and 7*b* are redundant. The NaF-towers 7*a* and 7*b* contain a pair of NaF-towers (two towers installed on a trolley for easy removal and exchange out of the skid-installation). If one of them is loaded with absorbed HF, it can be regenerated by passing $N_2$ or other inert gas at elevated/high-temperatures from line 10 through it.

The electrolyzer apparatus of the present invention is indicated by reference sign 11. It includes the cells 2 including the anodes (not shown in FIG. 4), the housings 12 for the rectifiers, a distributed control system DCS 13 and a programmable logic controller 14. The multitude of anodes in the cells 2 and the multitude of rectifiers in the rectifier housings 12, one rectifier connected to one anode, are not shown for the sake of simplicity, but are part of the electrolyzer apparatus, of course. If desired, two rectifiers may be joined in a dual rectifier as mentioned above.

The electrolyzer apparatus can be assembled in the form of a skid. In this embodiment, parts of the electrolyzer apparatus (for example, rectifiers and electrolyzer vessel including the anodes, lines providing HF, and lines to withdraw $F_2$) are mounted in a skid.

According to a preferred embodiment, the electrolyzer apparatus of the present invention is integrated in a fluorine producing plant according to the "skid concept". The term "skid concept" denotes a plant wherein parts of the plant are assembled in separate skids. The advantage is that the skids can be manufactured and tested in a factory by experienced workers, are sent skid by skid to the site where fluorine will be produced, and are assembled directly on that site. Such a concept is described in co-pending patent applications U.S. 61/383,533 and U.S. 61/383,204, later (on Sep. 12, 2011) re-filed as PCT patent application having the filing No. PCT/EP2011/065773 the whole content of which three applications is incorporated herein by reference for all purposes.

Such a plant comprises skid mounted modules including at least one skid mounted module selected from the group consisting of

- a skid mounted module comprising at least one storage tank for HF, denoted as skid 1,
- a skid mounted module comprising at least one electrolytic cell to produce $F_2$, denoted as skid 2, which corresponds to the electrolyzer apparatus of the present invention,
- a skid mounted module comprising purification means for purifying $F_2$, denoted as skid 3,
- a skid mounted module comprising means to deliver fluorine gas to the point of use, denoted as skid 4,
- a skid mounted module comprising cooling water circuits, denoted as skid 5,
- a skid mounted module comprising means to treat waste gas, denoted as skid 6,
- a skid mounted module comprising means for the analysis of $F_2$, denoted as skid 7, and
- a skid mounted module comprising means to operate the electrolysis cells, denoted as skid 8. This module corresponds to or comprises the central control system.

The plant preferably also comprises skid modules which may be located close to the skid modules 1 to 8 but may be separated from them, namely

- a skid module 9 which is an electrical sub-station mainly to transform medium voltage to low voltage
- a skid module 10 which houses utilities (control room, laboratory, rest room).

At least, skids 1, 2, 3, 4 and 7, preferably all skids, comprise housings for safety reasons.

Another aspect of the present invention is a method for the manufacture of elemental fluorine wherein the electrolyzer apparatus of the present invention can be applied.

The method of the present invention for the electrolytic manufacture of fluorine by electrolysis of a molten composition comprising HF and an electrolyte salt wherein an electrolyzer apparatus is used comprising at least one electrolytic cell which contains at least two anodes, a metallic cathodic vessel, and a number of rectifiers such that each anode is allocated to one rectifier; and each rectifier is allocated to one anode. The term "allocated" includes the meaning "connected".

Preferably, the method of the invention is performed with preferred embodiments of the electrolyzer apparatus as described above; especially, it is performed in a plant according to the skid concept as described in U.S. 61/383,533, filed Sep. 15, 2010, and U.S. 61/383,204, filed Sep. 16, 2010, the priority of which applications was claimed in PCT patent application filed on Sep. 12, 2011 having the filing No. PCT/EP2011/065773.

Preferably, the molten composition to be electrolyzed has the approximate composition KF·(1.8−2.3)HF.

Should the disclosure of any patents, patent applications, and publications which are incorporated herein by reference conflict with the description of the present application to the extent that it may render a term unclear, the present description shall take precedence.

The invention, and specifically the use of the electrolyzer apparatus and the method of the present invention in a method for the manufacture of fluorine, will now be described in further detail in view of an example describing a preferred apparatus and fluorine production method.

Example

The electrolyzer apparatus which may be mounted in a skid comprises 1 electrolytic cell which contains 26 anodes. The apparatus contains 13 dual rectifiers with a capacity of 12V/250 A, each individual rectifier of the dual rectifiers was connected to one anode. Each rectifier contains a DC current measuring device (e.g., an ampere meter), a voltage measuring device (e.g. a voltmeter) wherein current and voltage measurement may be provided by a single device, a short circuit protection based on which may be set to a shutdown limit of, for example, 250 A, a DC voltage overvoltage protection which may be set, for example, to 15 V, a digital bus connection between the anodes and a central anode control unit exchanging rectifier set up parameters. For each individual anode, the current loop control of the rectifier, be it closed or open, is steered by the distributed control system DCS and the PLC via a current set point and a manually set correction factor which are entered in the DCS. These data are managed in the PLC, a central anode control unit, which was a programmed Siemens S7-300 PLC controller. The DCS sets and the PLC controls the required current level for each rectifier, applies the respective correction factor for each anode, and allows reducing the electric charge of a particular anode, compared to the charge of others.

The tolerance band preferably is set to a direct current voltage (VDC) 12 V, and the direct current (IDC) is set to 240 A, as a reference.

Electrolyte salt of an approximate composition of KF·2HF is filled into the electrolytic cell vessels and is molten therein (at a temperature of about 85 to 100° C.). Electric supply is switched on for the rectifiers, and the electrolytic process is started. The PLC, the central anode unit, keeps voltage and current of each individual anode with the tolerance band entered into the central control unit for the specific anode. When electrolysis has started, the molten electrolyte salt is heated, and respective cooling is advantageous. By feeding appropriate amounts of HF into the vessel, the level of molten electrolyte is kept in a preset range. During the electrolysis, $F_2$ and $H_2$ are formed and are withdrawn separately from the cells. $H_2$ from the cells is fed into a common line, is diluted with inert gas and decomposed or passed into the atmosphere. Only during start-up-phase (conditioning-process of the electrolyte-mixture) or in case of emergency, the $F_2$ is sent to the $F_2$ destruction unit/$F_2$ abatement system. The $F_2$ formed is collected in a common line and purified. Often, it contains entrained solids, mainly solidified electrolyte salt. The purification can be performed as described in unpublished European patent application No. 10172034.0. According to the process for the fluorine purification described therein, the fluorine is contacted with liquid hydrogen fluoride, which preferably has a temperature equal to or higher than −83° C., more preferably, equal to or higher than −82° C., and preferably equal to or lower than −40° C. To provide highly pure $F_2$ as preferably applied in the manufacture as etching or chamber cleaning gas as mentioned above, it is subjected to a further purification treatment which preferably comprises at least one step of low temperature treatment to provide highly pure fluorine and optionally, an additional step of contacting the fluorine after the low temperature treatment with an adsorbent for HF, e.g. NaF, an additional step of passing the fluorine after the low temperature treatment through a filter, or both. In the deep temperature treatment, HF entrained is removed from $F_2$ by condensation or freezing it out. The low temperature treatment is preferably performed at a temperature equal to or lower than the freezing point of HF at the respective pressure; often, at a temperature equal to or lower than −82° C. The purified $F_2$ is then filled into a storage tank or forwarded to the tool where in it is used as etching gas or chamber cleaning gas.

If the current or voltage measurement devices detect that current or voltage are outside the preset tolerance band by a percentage which is higher than the correction factor which preferably is set to 5%, a digital shutdown command is sent to the central anode control unit which distributes the shutdown command to the respective anode rectifier or anode rectifiers connected with the respective anode which shut down the current and thus stop the electrolytic process of this or these individual anodes.

In this example, an alarm was sent to the operator identifying directly the defective cell and anode. The faulty anode or anodes can then be identified and repaired or substituted.

Another aspect of the present invention is a rectifier/anode system for the manufacture of $F_2$ by electrolysis of KF·(1.8–2.3)HF. The rectifier/anode system comprises at least two carbon anodes and at least two rectifiers each of which is individually connected with a rectifier.

The invention claimed is:

1. An electrolyzer apparatus for the electrolytic manufacture of elemental $F_2$ from an electrolyte comprising at least one electrolytic cell which contains at least two anodes, a metallic vessel made from stainless steel or nickel, which serves as the only cathode, for the electrolyte, and at least two rectifiers such that one rectifier is allocated to one anode, wherein the anodes are carbon anodes, and all rectifier (−) poles are connected to the vessel.

2. The electrolyzer apparatus of claim 1, containing equal to or more than 5 electrolytic cells.

3. The electrolyzer apparatus of claim 1, wherein each electrolytic cell contains from 20 to 30 anodes.

4. The electrolyzer apparatus of claim 1, wherein each rectifier is connected to a control unit which individually controls each rectifier.

5. The electrolyzer apparatus of claim 4, wherein the rectifier comprises at least one device which measures parameters of each anode; wherein the at least one device is selected from the group consisting of a DC measurement device, a current closed loop control device, a voltage measurement device, a DC current short circuit protection, and a DC voltage overvoltage protection, said parameters being measured in the rectifier and detected inside the control unit for each anode.

6. The electrolyzer apparatus of claim 1, comprising a programmable logic controller (PLC).

7. The electrolyzer apparatus of claim 1, further comprising a distributed control system (DCS) and/or a safety shutdown system.

8. The electrolyzer of claim 1, comprising a safety controller connected to at least one device selected from the group consisting of gas pressure detectors, temperature detectors, fire detectors, and smoke detectors.

9. The electrolyzer of claim 8, comprising at least two independent safety controllers.

10. The electrolyzer apparatus of claim 1, wherein two rectifiers are grouped into one dual rectifier.

11. The electrolyzer apparatus of claim 1, being arranged in the form of a skid.

12. A method for the electrolytic manufacture of fluorine by electrolysis of a molten composition comprising HF and an electrolyte salt wherein an electrolyzer apparatus is used, said electrolyzer apparatus comprising at least one electrolytic cell which contains at least two anodes, a metallic cathodic vessel, and a number of rectifiers such that each anode is allocated to one rectifier.

13. The method of claim 12, wherein the molten composition has the approximate composition KF·(1.8–2.3)HF.

14. The method of claim 12, wherein the electrolyzer apparatus comprises at least one feature selected from the group consisting of:

the anodes being carbon anodes;

containing 5 electrolytic cells or more; and each electrolytic cell containing from 20 to 30 anodes.

15. The method of claim 12, wherein the level of the current of each individual anode is set and maintained in a set level range by varying the voltage.

16. The method of claim 12, wherein each rectifier in the electrolyzer apparatus is connected to a control unit which individually controls each rectifier.

17. The method of claim 12, wherein each anode is controlled and regulated individually.

18. The electrolyzer apparatus of claim 1, wherein all rectifier (–) poles are connected to the vessel by a single bus bar.

* * * * *